US010340665B2

(12) United States Patent
Chuong Vo et al.

(10) Patent No.: US 10,340,665 B2
(45) Date of Patent: Jul. 2, 2019

(54) SPARK PLUG HAVING AN INCREASED TIGHTENING TORQUE

(71) Applicant: Robert Bosch GmbH, Stuttgart (DE)

(72) Inventors: Ba Thien Chuong Vo, Buehl (DE); Chris Schimmel, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/771,881

(22) PCT Filed: Oct. 20, 2016

(86) PCT No.: PCT/EP2016/075168
§ 371 (c)(1),
(2) Date: Apr. 27, 2018

(87) PCT Pub. No.: WO2017/076650
PCT Pub. Date: May 11, 2017

(65) Prior Publication Data

US 2018/0323582 A1 Nov. 8, 2018

(30) Foreign Application Priority Data

Nov. 2, 2015 (DE) ..... 10 2015 221 394

(51) Int. Cl.
*H01T 13/04* (2006.01)
*H01T 13/08* (2006.01)
*H01T 13/20* (2006.01)

(52) U.S. Cl.
CPC ..... *H01T 13/08* (2013.01); *H01T 13/20* (2013.01)

(58) Field of Classification Search
None
See application file for complete search history.

(56) References Cited

U.S. PATENT DOCUMENTS 2,330,807 A * 10/1943 Berstler ..... H01T 13/08 313/135
4,007,714 A * 2/1977 Jones ..... F02B 53/12 123/169 R
5,937,813 A 8/1999 Shifflette
7,176,608 B2 * 2/2007 Kanao ..... H01T 13/20 313/118

FOREIGN PATENT DOCUMENTS

| | | | |
|---|---|---|---|
| CH | 222618 | A | 7/1942 |
| CN | 201973041 | U | 9/2011 |
| DE | 69300924 | T2 | 4/1996 |
| DE | 19649742 | A1 | 6/1997 |
| DE | 102010003574 | A1 | 10/2011 |
| DE | 102012207319 | A1 | 11/2013 |
| JP | S5578758 | U | 5/1980 |

OTHER PUBLICATIONS

International Search Report for PCT/EP2016/075168, dated Jan. 27, 2017.

* cited by examiner

*Primary Examiner* — Vip Patel
(74) *Attorney, Agent, or Firm* — Norton Rose Fulbright US LLP; Gerard Messina

(57) ABSTRACT

A spark plug, including an insulator, a casing including a sealing surface, and a gasket which rests against the sealing surface, the sealing surface including a plurality of recesses.

14 Claims, 4 Drawing Sheets

SPARK PLUG HAVING AN INCREASED TIGHTENING TORQUE

FIELD OF THE INVENTION

The present invention relates to a spark plug which may be fixed at an increased tightening torque in a cylinder head or the like of an internal combustion engine.

BACKGROUND INFORMATION

Spark plugs are discussed in the related art in various embodiments. Spark plugs are usually screwed into a tapped bore in a cylinder head with the aid of a thread. In the process of screwing the spark plug into the cylinder head bore, torques between 10 Nm and 30 Nm are generally applied. The thread of the spark plug is usually provided at a casing of the spark plug. A sealing between the casing and the cylinder head takes place via an outer gasket at the casing, for example, which is generally provided in a folded form and which is squeezed when the spark plug is screwed into it. Due to the rising demand in the field of internal combustion engines, smaller engines having smaller cylinder heads and a more compact design have been recently increasingly used. For this purpose, smaller spark plugs are needed, however, which transition from thread sizes M14 and M12 to thread sizes M10 and M8. However, the process of screwing the spark plug into the cylinder head bore may result in a plastic deformation of the thread or even a crack in the casing of the spark plug due to the smaller size of the thread. In order to securely fix the spark plug, it must, however, be inserted into the cylinder head at a predetermined minimum torque, since otherwise leakages and an unintentional loosening of the spark plug may occur.

SUMMARY OF THE INVENTION

The spark plug according to the present invention having the features described herein is believed to have the advantage over the related art that the spark plugs may be inserted into a cylinder head bore at high tightening torques despite reduced dimensions. In this case, deformations of the thread connection between the spark plug and the cylinder head do not occur. According to the present invention, an increased friction coefficient between a gasket and the spark plug on the one hand and the gasket and the cylinder head bore on the other hand is achieved, in particular. This makes it possible to achieve an increased resistance to loosening of the spark plug. This is achieved according to the present invention in that the spark plug includes an insulator, a casing having a sealing surface, and a gasket. The gasket rests against the sealing surface of the casing and the sealing surface includes a plurality of recesses. With the aid of the plurality of recesses on the sealing surface it is achieved that, when the spark plug is screwed into the cylinder head bore, the gasket is plastically deformed and fills the recesses in the sealing surface partially and/or completely. In particular, not only an improved friction fit between the gasket and the casing of the spark plug is thus achieved, but also a partial or complete form fit at the gasket. In this way, increased friction coefficients may be achieved. Advantageously, the friction coefficient is at least 0.25.

The further descriptions herein describe further refinements of the present invention.

The recesses in the sealing surface may be open toward an outer periphery of the casing of the spark plug. This allows, in particular, for an easier plastic deformation of the gasket during the screwing-in. Furthermore, plastically deformed excess material of the gasket may exit at the open side of the recess, if necessary.

It may further be provided that the sealing surface is provided at a circumferential projection of the casing. In this way, a good sealing may be achieved in particular between the spark plug and the cylinder head.

The sealing surface may be situated at a shell area of the casing provided perpendicularly to the axial direction of the spark plug. In this way, an outer gasket is also used for fixing and sealing the spark plug at the cylinder head bore.

According to another embodiment of the present invention, the recesses are situated at uniform distances in the peripheral direction on the sealing surface. A uniform friction coefficient along the periphery between the gasket and the casing is thus ensured.

It further may be provided that a thickness of the gasket is greater than a depth of the recesses in the sealing surface. The thickness may be greater than a depth of the recesses by a factor in a range from 4 to 6.

According to another embodiment of the present invention, an outer periphery of the sealing surface corresponds to the greatest diameter of the casing of the spark plug. This allows for a large sealing surface area between the gasket and the casing of the spark plug.

An abrupt transition may be provided between the recesses and the sealing surface. In this way, particularly high friction coefficients between the gasket and the sealing surface may be achieved in the assembled state.

An even number of recesses, in particular between 4 and 10 recesses, may be provided on the sealing surface.

Furthermore, the casing may include a metric ISO thread M10 or an M8 according to DIN 13-1, edition 11.1999. In this way, the dimensions of the casing and thus of the entire spark plug may be reduced so that they are suited, in particular, for small-sized engines having limited space conditions.

Furthermore, the present invention relates to an internal combustion engine including a spark plug according to the present invention, a metric M10 thread or a metric M8 thread according to DIN 13-1, edition 11.1999, being provided between the spark plug and a cylinder head of the internal combustion engine.

Exemplary embodiments of the present invention will be described in detail below with reference to the accompanying drawings.

DETAILED DESCRIPTION

A spark plug 1 according to a first exemplary embodiment of the present invention is described in detail below with reference to FIGS. 1 through 4.

Figure 1:
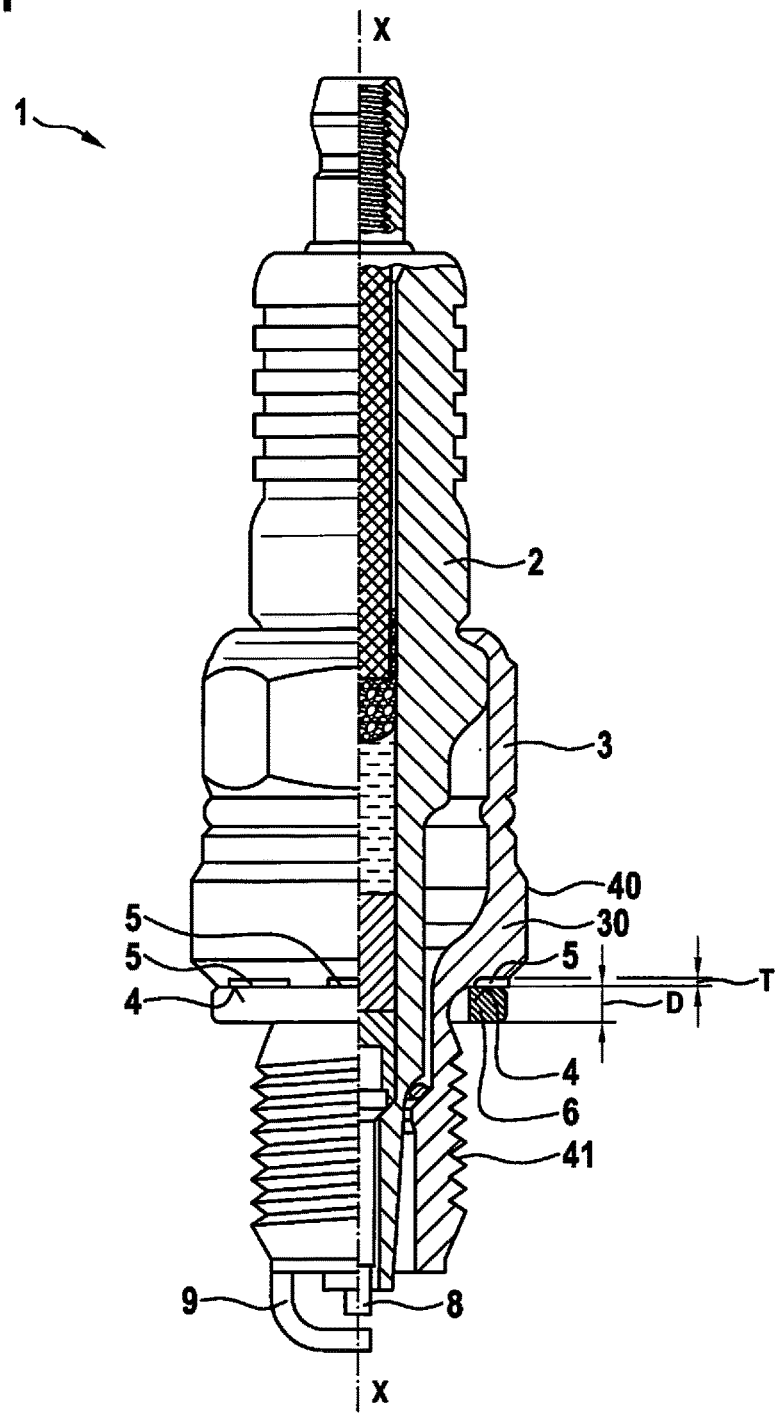
FIG. 1 shows a schematic, partial sectional view of a spark plug according to one exemplary embodiment of the present invention.

Spark plug 1 includes an insulator 2 which is usually manufactured from a ceramic material. Furthermore, a casing 3 is provided which is provided (manufactured) from a metallic material. Reference numeral 8 identifies a center electrode and reference numeral 9 identifies a ground electrode. FIG. 1 shows the spark plug in section in axial direction X-X.

Spark plug 1 further includes a sealing surface 4 which is provided at casing 3. In this case, sealing surface 4 is oriented perpendicularly to axial direction X-X. Sealing surface 4 is provided at a projection 30 of casing 3. An outer periphery 40 in the area of projection 30 is greater than a diameter of a male thread 41 for the purpose of fixing the spark plug in a cylinder head. Outer periphery 40 provides the largest diameter of casing 3.

Figure 3:
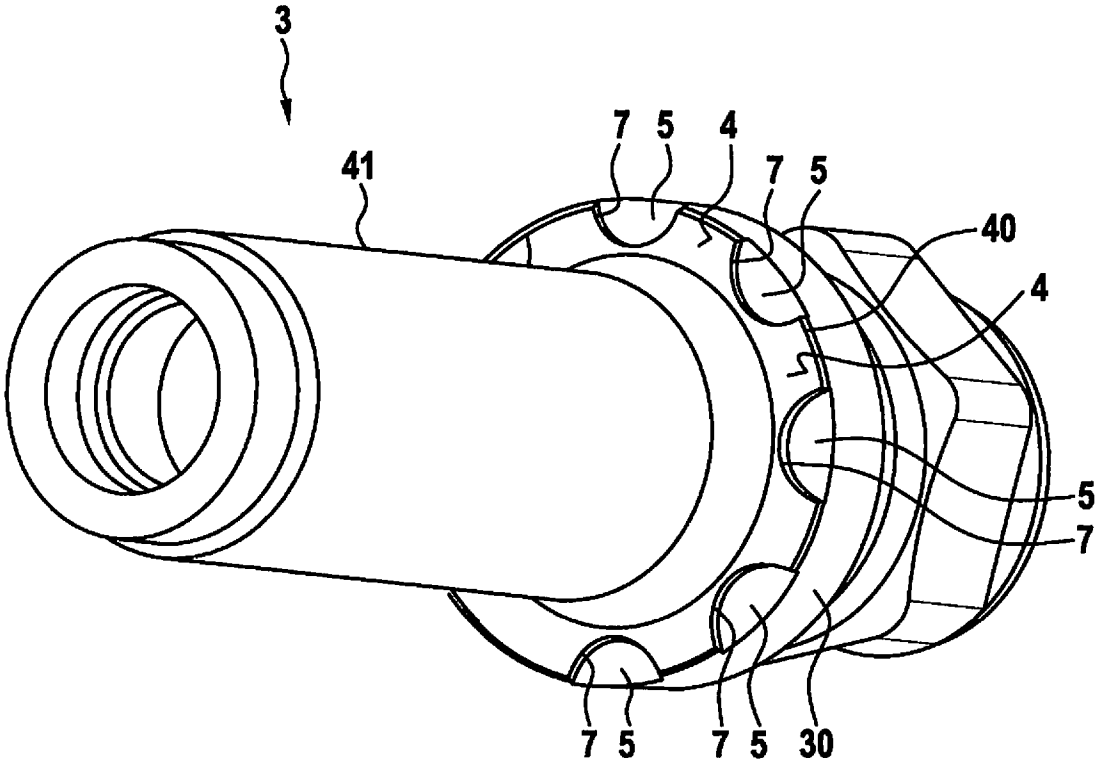
FIG. 3 shows a schematic, perspective view of the casing from FIG. 2 without the gasket.
Figure 4:
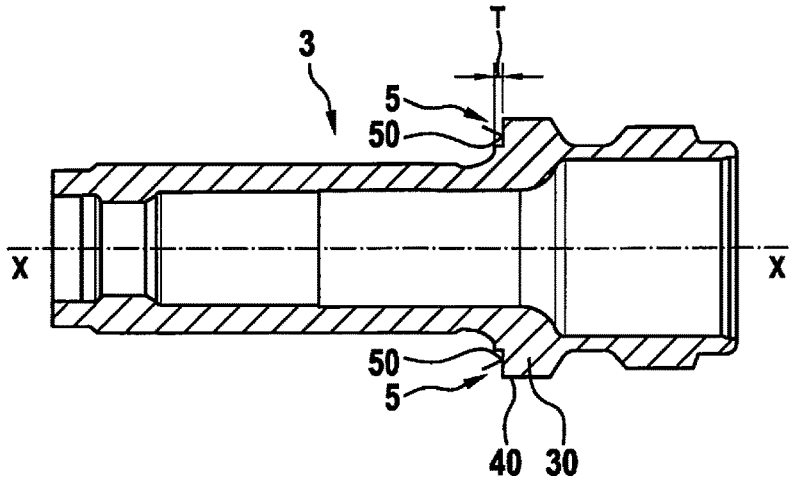
FIG. 4 shows a schematic sectional view of a casing of the spark plug from FIG. 1.

As is apparent from FIG. 3 in particular, sealing surface 4 includes a plurality of recesses 5. Eight recesses 5 are provided in this exemplary embodiment. Recesses 5 are arc-shaped and open in the direction of outer periphery 40 (cf. FIGS. 3 and 4). Alternatively, recesses 5 may also be wedge-shaped, wedge-shaped recesses 5 extending from outer periphery 40 in the direction of the longitudinal axis of the spark plug. In this case, the tip of wedge-shaped recess 5 is situated in the direction of the longitudinal axis of the spark plug and the basis of wedge-shaped recess 5 is situated in the direction of outer periphery 40, the basis of wedge-shaped recess 5 being open in the direction of outer periphery 40.

An abrupt transition 7 is provided between recesses 5 and sealing surface 4 in each case. A base area 50 of recesses 5 is in parallel to the area of sealing surfaces 4.

As is further apparent from FIG. 1, spark plug 1 includes a gasket 6. In the assembled state, gasket 6 rests against sealing surface 4. Gasket 6 has a rectangular cross section, in particular a square cross section.

A thickness D of gasket 6 in axial direction X-X of the spark plug is greater than a depth T of recess 5 in axial direction X-X.

The depth of the recesses may be in a range from 0.1 mm to 1 mm.

Figure 2:
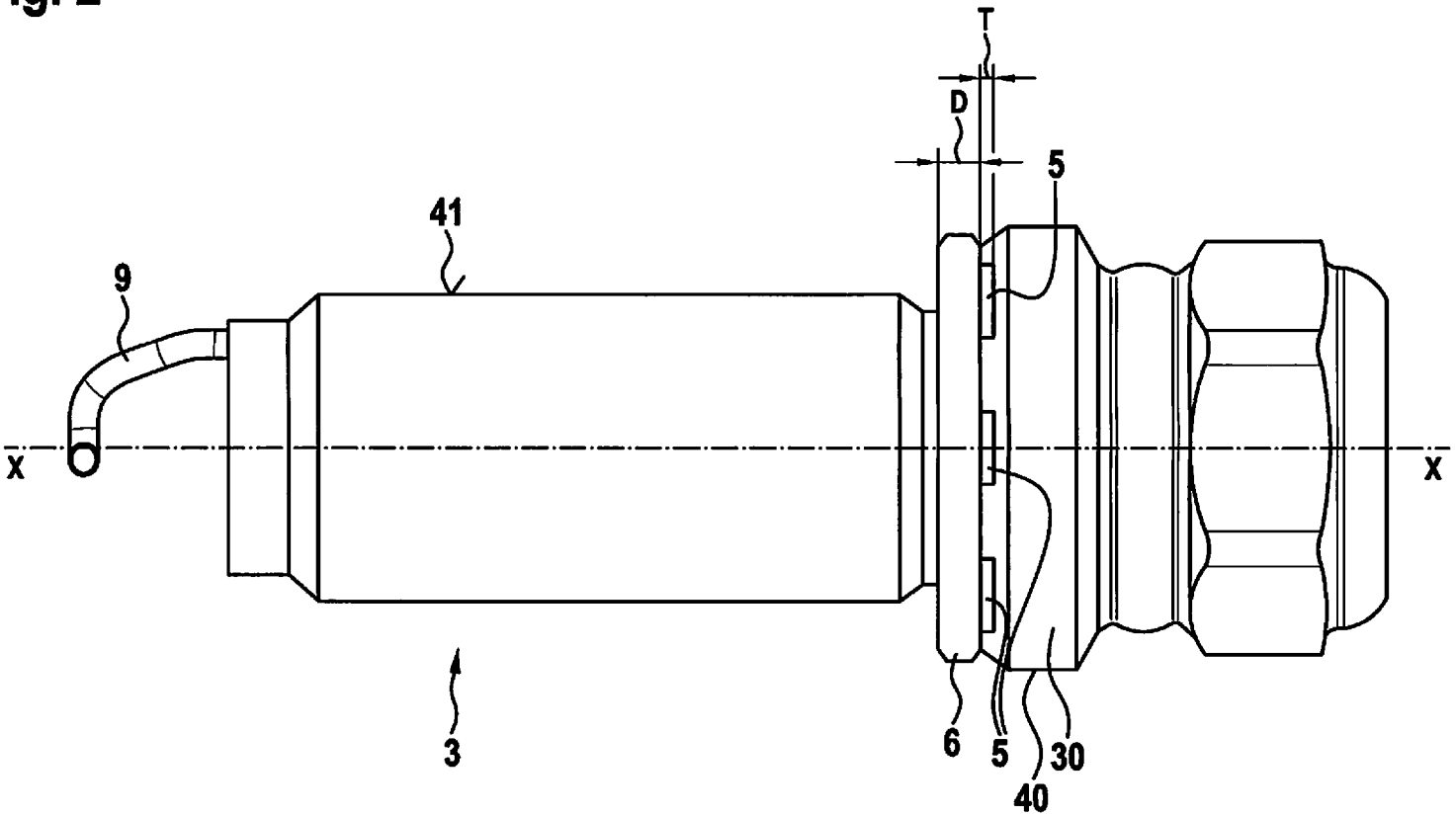
FIG. 2 shows a schematic side view of a casing of the spark plug from FIG. 1 including an inserted gasket.

FIG. 2 shows the state of the spark plug in which gasket 6 lies loosely on sealing surface 4. Here, recesses 5 having depth T are clearly recognizable. When spark plug 1 is screwed into a cylinder head bore (not shown) including a female thread, a plastic deformation of gasket 6 takes place, as soon as gasket 6 lies on a contact surface of the cylinder head, in such a way that gasket 6 fills recesses 5 partially or completely. The open design of recesses 5 toward the radial outer face (cf. FIG. 3) thus allows plastically deformed excess material of gasket 6 to flow out, if necessary.

According to the present invention, a form-locked connection between plastically deformed gasket 6 and recesses 5 is thus achieved during the screwing-in process in addition to the force-fitted connection between sealing surface 4 and gasket 6. This allows for a higher friction coefficient between the gasket and casing 3. The result is a considerably higher resistance to loosening of the spark plug, so that the spark plug, even in the case of a smaller thread diameter of male thread 41, for example M8 or M10 (metric thread DIN 13-1, edition 11.1999), may be fixed in the cylinder head at a high tightening torque without either causing damage to the turns of the thread or even a crack in casing 3.

It should be noted that a sum of all the surfaces of recesses 5 corresponds to approximately 50% of the total surface area of the surface of gasket 6 oriented toward sealing surface 4.

Recesses 5 may be generated with the aid of a shaping process using an appropriately shaped die.

It further may be provided that a surface area of sealing surface 4 and recesses 5 is configured to have a predetermined roughness. In this way, a friction coefficient may be further increased. Advantageously, the friction coefficient is at least 0.25.

According to the present invention, a spark plug may thus be provided for smaller internal combustion engines including a relatively small thread which may be fixed at an increased tightening torque despite the smaller metric thread (for example M8 or M10).

What is claimed is:

1. A spark plug, comprising:
an insulator;
a casing including a sealing surface; and
a gasket which rests against the sealing surface;
wherein the sealing surface includes a plurality of recesses, wherein a form-locked connection is present between the recesses and the gasket.

2. The spark plug of claim 1, wherein the recesses are open toward an outer periphery of the casing.

3. The spark plug of claim 1, wherein the sealing surface is provided on the casing at a peripheral projection of the casing.

4. The spark plug of claim 1, wherein the sealing surface is situated at a shell area of the casing provided perpendicularly to an axial direction of the spark plug.

5. The spark plug of claim 1, wherein the recesses are situated at uniform distances in the peripheral direction.

6. The spark plug of claim 1, wherein an outer periphery of the sealing surface corresponds to the greatest diameter of the casing.

7. The spark plug of claim 1, wherein an abrupt transition is provided between the recesses and the sealing surface.

8. The spark plug of claim 1, wherein the number of the recesses is an even number.

9. The spark plug of claim 1, wherein a male thread is provided on the casing as a metric thread M10 or M8.

10. The spark plug of claim 1, wherein the number of the recesses is an even number, in a range from 4 to 10 recesses.

11. The spark plug of claim 1, wherein in an assembled state of the spark plug, the gasket is plastically deformed such that a material of the gasket fills the recesses at least partially.

12. A spark plug, comprising:
an insulator;
a casing including a sealing surface; and
a gasket which rests against the sealing surface;
wherein the sealing surface includes a plurality of recesses, and wherein a thickness of the gasket in an axial direction of the spark plug is greater than a depth of the recesses in the axial direction of the spark plug.

13. An internal combustion engine, comprising:
a spark plug, including:
an insulator;
a casing including a sealing surface; and
a gasket which rests against the sealing surface;
wherein the sealing surface includes a plurality of recesses, wherein a form-locked connection is present between the recesses and the gasket; and
a metric M8 thread connection or a metric M10 thread connection between the spark plug and the cylinder head.

14. The internal combustion engine of claim 13, wherein in an assembled state of the spark plug, the gasket is plastically deformed such that a material of the gasket fills the recesses at least partially.

* * * * *